US006941717B2

(12) United States Patent
Hohmann et al.

(10) Patent No.: US 6,941,717 B2
(45) **Date of Patent: *Sep. 13, 2005**

(54) WALL ANCHOR CONSTRUCTS AND SURFACE-MOUNTED ANCHORING SYSTEMS UTILIZING THE SAME

(75) Inventors: Ronald P. Hohmann, Hauppauge, NY (US); Ronald P Hohmann, Jr., Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/427,502

(22) Filed: May 1, 2003

(65) Prior Publication Data

US 2004/0216413 A1 Nov. 4, 2004

(51) Int. Cl.[7] ..... E04B 2/00
(52) U.S. Cl. ..... 52/506.01; 52/713
(58) Field of Search ..... 52/506.01, 713, 52/378, 379, 513

(56) References Cited

U.S. PATENT DOCUMENTS

| | | | | |
|---|---|---|---|---|
| 2,058,148 A | | 10/1936 | Hard | |
| 2,966,705 A | | 1/1961 | Massey | |
| 3,053,491 A | * | 9/1962 | Ramser | 248/48.2 |
| 3,377,764 A | | 4/1968 | Storch | |
| 4,021,990 A | | 5/1977 | Schwalberg | 52/714 |
| 4,305,239 A | | 12/1981 | Geraghty | 52/715 |
| 4,373,314 A | | 2/1983 | Allan | 52/434 |
| 4,438,611 A | | 3/1984 | Bryant | 52/309.2 |
| 4,473,984 A | | 10/1984 | Lopez | 52/410 |
| 4,598,518 A | | 7/1986 | Hohmann | 52/410 |
| 4,614,070 A | * | 9/1986 | Idland | 52/296 |
| 4,869,038 A | | 9/1989 | Catani | 52/410 |
| 4,875,319 A | | 10/1989 | Hohmann | 52/383 |
| 4,922,680 A | * | 5/1990 | Kramer et al. | 52/713 |
| 5,392,581 A | | 2/1995 | Hatzinikolas et al. | 52/712 |
| 5,408,798 A | | 4/1995 | Hohmann | 52/562 |
| 5,440,854 A | * | 8/1995 | Hohmann | 52/489.1 |
| 5,456,052 A | | 10/1995 | Anderson et al. | 52/713 |
| 5,634,310 A | * | 6/1997 | Hohmann | 52/513 |
| 5,816,008 A | | 10/1998 | Hohmann | 52/565 |
| 6,209,281 B1 | | 4/2001 | Rice | 52/714 |
| 6,209,826 B1 | * | 4/2001 | Pratt, Jr. | 248/48.2 |
| 6,279,283 B1 | | 8/2001 | Hohmann et al. | 52/379 |

FOREIGN PATENT DOCUMENTS

GB 2212835 A * 8/1989 ..... E04B/2/30

OTHER PUBLICATIONS

Building Envelope Requirements, 780 CMR§1304.0 et seq. of Chapter 13; Boston, MA, Jan. 1, 2001.
Dur–O–Wal, Inc., Product Catalog (Aurora, Il; 2000).
Wire Bond Corp.; Product Catalog (Charlotte, NC; 2002/2003).
Hohmann & Barnard, Inc.; Product Catalog (Hauppauge, NY; 2002).
Blok–Lok, Ltd.; Product Catalog (Weston, Ont, Canada; 1991).

* cited by examiner

*Primary Examiner*—Kimberly T. Wood
(74) *Attorney, Agent, or Firm*—Siegmar Silber

(57) ABSTRACT

Wall anchor constructs and anchoring systems employing the same are disclosed. Each anchor is a sheetmetal construct utilizable with various wire formative veneer ties. In the wall anchor structures, the junctures of the legs and the base of the wall anchor are located inboard from the periphery of the wall anchor base. With the surfaces of the leg base and the anchor base coplanar, the leg insertion point is, upon installation, sealed thereby. This sealing precludes penetration of air, Moisture, and water vapor into the wall structure. Various embodiments showing wall anchor configurations with suitable veneer ties are provided.

13 Claims, 7 Drawing Sheets

WALL ANCHOR CONSTRUCTS AND SURFACE-MOUNTED ANCHORING SYSTEMS UTILIZING THE SAME

CROSS-REFERENCES TO RELATED APPLICATIONS

This application is a continuation-in-part of the following application: U.S. Patent Application entitled FOLDED WALL ANCHOR AND SURFACE-MOUNTED ANCHORING filed recently.

BACKGROUND OF THE INVENTION

1. Field of the Invention

This invention relates to wall anchor constructs and to surface-mounted anchoring systems employing the same, both of which are used in cavity walls. More particularly, the invention relates to sheetmetal wall anchors and wire formative veneer ties that comprise positive interlocking components of the anchoring system. The system has application to seismic-resistant to cavity walls and other structures having special requirements. The latter include high-strength requirements for jumbo brick and stone block veneers and high-span requirements for larger cavities with thick insulation.

2. Description of the Prior Art

In the late 1980's, surface-mounted wall anchors were developed by Hohmann & Barnard, Inc., patented under U.S. Pat. No. 4,598,518 of the first-named inventor hereof. The invention was commercialized under trademarks DW-10, DW-10-X, and DW-10-HS. These widely accepted building specialty products were designed primarily for dry-wall construction, but were also used with masonry backup walls. For seismic applications, it was common practice to use these wall anchor as part of the DW-10 Seismiclip interlock system which added a Byna-Tie wire formative, a Seismiclip snap-in device—described in U.S. Pat. No. 4,875,319 ('319), and a continuous wire reinforcement.

In the dry wall application, the surface-mounted wall anchor of the above-described system has pronged legs that pierce the insulation and the wall board and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined the effects of various forces, particularly lateral forces, upon brick veneer masonry construction. However, under certain conditions, the system did not sufficiently maintain the integrity of the insulation.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a for continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for deposition in a bed joint of the outer wythe. It is instructive to note that pin-point loading—that is forces concentrated at substantially a single point—developed from this design configuration. Upon experiencing lateral forces over time, this resulted in the loosening of the stud.

Exemplary of the public sector building specification is that of the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe.

As insulation became thicker, the tearing of insulation during-installation of the pronged DW-10X wall anchor, see supra, became more prevalent. This occurred as the installer would fully insert one side of the wall anchor before seating the other side. The tearing would occur during the arcuate path of the insertion of the second leg. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater retention of insulation integrity and less reliance on a patch.

Another prior art development occurred shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results.

In recent building codes for masonry structures a trend away from eye and pintle structures is seen in that newer codes require adjustable anchors be detailed to prevent disengagement. This has led to anchoring systems in which the open end of the veneer tie is embedded in the corresponding bed joint of the veneer and precludes disengagement by vertical displacement.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire.

Contractors found that heavy wire anchors, with diameters approaching the mortar layer height specification, frequently result in misalignment. This led to the low-profile wall anchors of the inventors hereof as described in U.S. Pat. No. 6,279,283. However, the above-described technology did not address the adaption thereof to surface mounted devices.

In the course of prosecution of U.S. Pat. No. 4,598,518 (Hohmann '518) several patents, indicated by an asterisk on the tabulation below, became known to the inventors hereof and are acknowledged hereby. Thereafter and in preparing for this disclosure, the additional patents which became known to the inventors are discussed further as to the significance thereof:

| Patent | Inventor | O.Cl. | Issue Date |
|---|---|---|---|
| 2,058,148* | Hard | 52/714 | October 1936 |
| 2,966,705* | Massey | 52/714 | January 1961 |
| 3,377,764 | Storch | | Apr. 16, 1968 |
| 4,021,990* | Schwalberg | 52/714 | May 10, 1977 |
| 4,305,239* | Geraghty | 52/713 | December 1981 |
| 4,373,314 | Allan | | Feb. 15, 1983 |
| 4,438,611* | Bryant | 52/410 | March 1984 |
| 4,473,984 | Lopez | | Oct. 02, 1984 |
| 4,598,518 | Hohmann | | Jul. 08, 1986 |
| 4,869,038 | Catani | | Sep. 26, 1989 |
| 4,875,319 | Hohmann | | Oct. 24, 1989 |
| 5,392,581 | Hatzinikolas et al. | | Feb. 28, 1995 |
| 5,408,798 | Hohmann | | Apr. 25, 1995 |
| 5,456,052 | Anderson et al. | | Oct. 10, 1995 |
| 5,816,008 | Hohmann | | Oct. 15, 1998 |
| 6,209,281 | Rice | | Apr. 03, 2001 |
| 6,279,283 | Hohmann et al. | | Aug. 28, 2001 |
| | Foreign Patent Documents | | |
| 279209* | CH | 52/714 | March 1952 |
| 2069024* | GB | 52/714 | August 1981 |

Note:
Original classification provided for asterisked items only.

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—D. Storch—Issued Apr. 4, 1968 Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 5, 1977 Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat. No. 4,373,314—J. A. Allan—Issued Feb. 2, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 10, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued Sep. 26, 1989 Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4.879,319—R. Hohmann—Issued Oct. 24, 1989 Discloses a seismic construction system for anchoring a facing veneer to wallboard/metal stud construction with a pronged sheet-metal anchor. Wall tie is distinguished over that of Schwalberg '990 and is clipped onto a straight wire run.

U.S. Pat. No. 5,392,581—Hatzinikolas et al.—Issued Feb. 2, 1995 Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 4, 1995 Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995 Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998 Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Rice—Issued Apr. 3, 2001 Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001 Discloses a low-profile wall tie primarily for use in renovation construction where in order to match existing mortar height in the facing wythe a compressed wall tie is embedded in the bed joint of the brick veneer.

None of the above provide the high-strength, surface-mounted wall anchor or anchoring systems utilizing these devices of this invention. As will become clear in reviewing the disclosure which follows, the cavity wall structures benefit from the recent developments described herein that lead to solving the problems of insulation integrity, of interference from excess mortar, and of high-span applications. In the related Application, wire formatives are compressively reduced in height at the junctures between the wall reinforcements and the wall anchors and various techniques of forming junctures between embedded wire formatives are introduced.

SUMMARY

In general terms, the invention disclosed hereby is a surface mounted wall anchor and an anchoring system employing the same. The wall anchor is a sheetmetal construct device which is described herein as functioning with various wire formative veneer ties. The two-and three-piece construction of the wall ties hereof enable the junctures of the legs and the base of the wall anchor to be located inboard from the periphery of the wall anchor. During formation of the wall anchor, the underside of the base is maintained as a flat, planar surface. Upon installation, the element(s) forming the flat base act to seal the insertion point where the legs enter into the exterior layer of building materials on the inner wythe. This sealing effect precludes the penetration of air, moisture, and water vapor through the insulation and/or wallboard, as the case may be, into the rest of the inner wythe structure.

In the first embodiment, the two-piece wall anchor is an improvement of the earlier inventions of Schwalberg, U.S. Pat. No. 4,021,990 and of Hohmann, U.S. Pat. No. 4,875,319, see supra. Here it is seen that the two-piece wall anchor (with legs moved inboard) together with a swaged veneer tie and wire reinforcement in the outer wythe creates a seismic construct of superior strength. This construct is applied to a dry wall inner wythe having thick insulation over wallboard, a larger-than-normal cavity, and a facing of jumbo brick.

In the second and third embodiments, the wall anchor constructs are of the winged variety. The wings in the second embodiment are perforated and permit selectively adjustable positioning of the veneer tie. Here a wall anchor construct together with a standard box veneer tie is applied to a dry wall inner wythe having interior insulation and, thus, the wall anchor legs have only to penetrate the wallboard layer. In the third embodiment, the wings are slotted with a centrally disposed reinforcement bar. The two-piece wall anchor is paired with a canted, low-profile veneer anchor. The two-piece wall anchor is surface-mounted to a masonry block inner wythe having insulation on the exterior surface and a brick facing. The use of innovative family of surface-mounted wall anchors in various applications address the problems of insulation integrity, thermal conductivity, and pin-point loading encountered in the previously discussed prior art.

OBJECTS AND FEATURES OF THE INVENTION

Accordingly, it is the primary object of the present invention to provide a new and novel anchoring systems for cavity walls, which systems are surface mountable to the backup wythe thereof.

It is another object of the present invention to provide a new and novel wall anchor mounted on the exterior surface of the wall board or the insulation layer and secured to the metal stud or standard framing member of a dry wall construction.

It is yet another object of the present invention to provide an anchoring system which is detailed to prevent disengagement under seismic or other severe environmental conditions.

It is still yet another object of the present invention to provide an anchoring system which is constructed to maintain insulation integrity by preventing air and water penetration.

It is a feature of the present invention that the two-piece wall anchor constructs hereof have planar baseplates for sealing against the leg insertion points.

It is another feature of the present invention that the legs of the wall anchors hereof have only point contact with the metal studs with substantially no resultant thermal conductivity.

It is yet another feature of the present invention that the bearing area between the wall anchor and the veneer tie spreads the forces thereacross and avoids pin-point loading.

Other objects and features of the invention will become apparent upon review of the drawing and the detailed description which follows.

BRIEF DESCRIPTION OF THE DRAWING

In the following drawing, the same parts in the various views are afforded the same reference designators.

DESCRIPTION OF THE PREFERRED EMBODIMENTS

Figure 1:
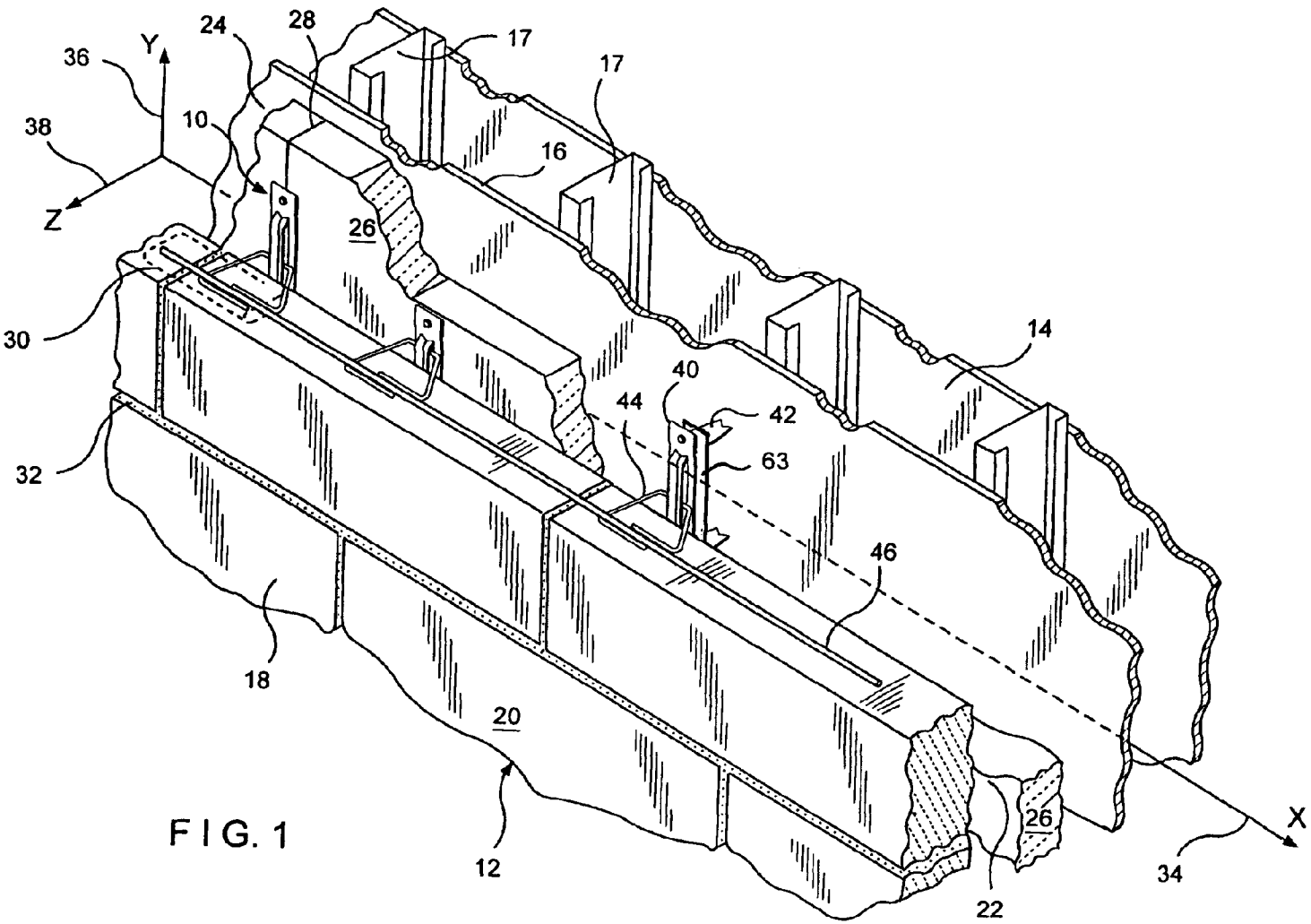
FIG. 1 shows a first embodiment of this invention and is a perspective view of a surface-mounted anchoring system as applied to a cavity wall having a larger-than-normal cavity with an inner wythe of dry wall construction having thick insulation in the cavity and an outer wythe of brick.

Before entering into the detailed Description of the Preferred Embodiments, several terms which will be revisited later are defined. These terms are relevant to discussions of innovations introduced by the improvements of this disclosure that overcome the deficits of the prior art devices.

In the embodiments described hereinbelow, the inner wythe is provided with insulation. In the dry wall construction, this takes the form, in one embodiment, of exterior insulation disposed on the outer surface of the inner wythe and, in another embodiment, of interior insulation disposed between the metal columns of the inner wythe. In the masonry block backup wall construction, insulation is applied to the outer surface of the masonry block. Recently, building codes have required that after the anchoring system is installed and, prior to the inner wythe being closed up, that an inspection be made for insulation integrity to ensure that the insulation prevents infiltration of air and moisture. Here the term insulation integrity is used in the same sense as the building code in that, after the installation of the anchoring system, there is no change or interference with the insulative properties and concomitantly substantially no change in the air and moisture infiltration characteristics.

In a related sense, prior art sheetmetal anchors have formed a conductive bridge between the wall cavity and the interior of the building. Here the terms thermal conductivity and thermal conductivity analysis are used to examine this phenomenon and the metal-to-metal contacts across the inner wythe.

Anchoring systems for cavity walls are used to secure veneer facings to a building and overcome seismic and other forces, i.e. wind shear, etc. In the past, some systems have experienced failure because the forces have been concentrated at substantially a single point. Here, the term pin-point loading refers to an anchoring system wherein forces are concentrated at a single point.

In addition to that which occurs at the facing wythe, attention is further drawn to the construction at the exterior surface of the inner or backup wythe. Here there are two concerns. namely, maximizing the strength of the securement of the surface-mounted wall anchor to the backup wall and, as previously discussed minimizing the interference of the anchoring system with the insulation. The first concern is addressed using appropriate fasteners such as, for mounting to masonry block, the properly sized concrete threaded anchors with expansion sleeves or concrete expansion bolts and, for mounting to metal, dry-wall studs, self-tapping screws. The latter concern is addressed by the flatness of the base of the surface-mounted, wall anchor construct which surround the openings formed by the legs (the profile is seen in the cross-sectional drawing FIG. 4).

In the detailed description, the veneer reinforcements and the veneer anchors are wire formatives, the wire used in the fabrication of veneer joint reinforcement conforms to the requirements of ASTM Standard Specification A951-00, Table 1. For the purpose fo this application tensile strength tests and yield tests of veneer joint reinforcements are, where applicable, those denominated in ASTM A-951-00 Standard Specification for Masonry Joint Reinforcement.

Referring now to FIGS. 1 through 4, the first embodiment shows a surface-mounted anchoring system suitable for seismic zone applications. This anchoring system, discussed in detail hereinbelow, has a two-piece wall anchor, an interengaging veneer tie, and a veneer (outer wythe) reinforcement and is surface mounted on an externally insulated dry wall. For the first embodiment, a cavity wall having an insulative layer of 2.5 inches (approx.) and a total span of 3.5 inches (approx.) is chosen as exemplary. As the veneer being anchored is a jumbo brick veneer, the anchoring system includes extra vertical adjustment.

The surface-mounted anchoring system for cavity walls is referred to generally by the numeral 10. A cavity wall structure 12 is shown having an inner wythe or dry wall backup 14 with sheetrock or wallboard 16 mounted on metal studs or columns 17 and an outer wythe or facing wall 18 of brick 20 construction. Between the inner wythe 14 and the outer wythe 18, a cavity 22 is formed. The cavity 22, which has a 3.5-inch span, has attached to the exterior surface 24 of the inner wythe 14 insulation in the form of insulating panels 26. The insulation 26 is disposed on wallboard 16. Seams 28 between adjacent panels of insulation 26 are substantially vertical and each aligns with the center of a column 17.

Successive bed joints 30 and 32 are substantially planar and horizontally disposed and in accord with building standards are 0.375-inch (approx.) in height. Selective ones of bed joints 30 and 32, which are formed between courses of bricks 20, are constructed to receive therewithin the insertion portion of the anchoring system hereof. Being surface mounted onto the inner wythe, the anchoring system 10 is constructed cooperatively therewith, and as described in greater detail below, is configured to minimize air and moisture penetration around the wall anchor/inner wythe juncture.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes. A two-piece wall anchor 40 is shown which has an inner or U-shaped-leg portion 42 nested therewithin. The legs penetrate the wallboard 16 insulation 26. Two-piece wall anchor 40 is a stamped metal construct which is constructed for surface mounting on inner wythe 14 and for interconnection with veneer tie 44.

The veneer tie 44 is adapted from one shown and described in Hohmann, U.S. Pat. No. 4,875,319, which patent is incorporated herein by reference. The veneer tie 44 is shown in FIG. 1 as being emplaced on a course of bricks 20 in preparation for embedment in the mortar of bed joint 30. In this embodiment, the system includes a veneer or outer wythe reinforcement 46, a wall anchor 40 and a veneer tie 44. The veneer reinforcement 46 is constructed of a wire formative conforming to the joint reinforcement requirements of ASTM Standard Specification A951-00, Table 1, see supra.

Figure 2:
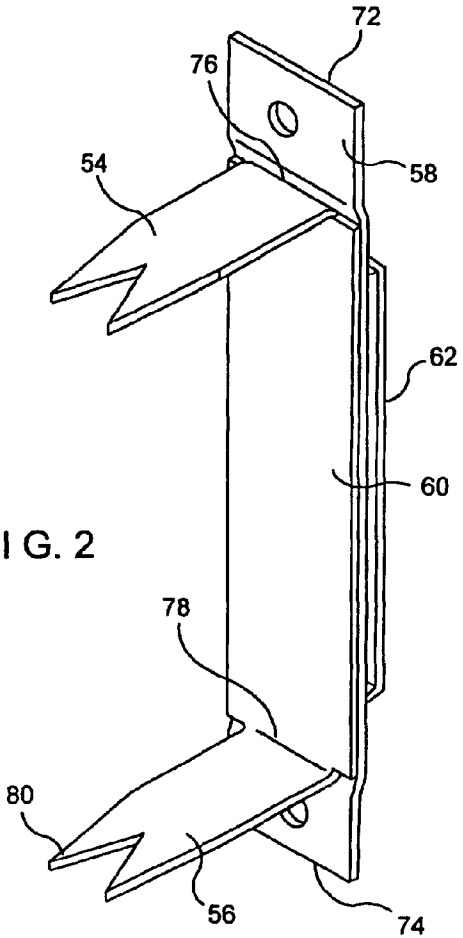
FIG. 2 is a rear perspective view showing the wall anchor construct of the surface-mounted anchoring system of FIG. 1.

At intervals along a horizontal line surface 24, two-piece wall anchors 40 are surface-mounted using mounting hardware 48. The two-piece wall anchors 40 are positioned on surface 24 so that the longitudinal axis of a column 17 lies within the yz-plane formed by the longitudinal axes 50 and 52 of upper leg 54 and lower leg 56, respectively. As best shown in FIG.2, the legs 54 and 56 are constructed so that the base surface 58 of the outer portions and the base surface 60 of the inner portion are substantially coplanar and, when installed, lie in an xy-plane. It is noted that the inner portion 42 covers the opening formed from stamping out the bail or bar 62 in the outer portion. Upon insertion of the legs 54 and 56 into insulation 26, the base surfaces 58 and 60 suround the openings formed by the insertions. As the surfaces 58 and 60 rest snugly against the insulation, the insertion opening is covered precluding the passage of air and moisture therethrough. This construct maintains the insulation integrity. Optionally, a layer of Textroseal® sealant 63, a thick multiply polyethylene/polymer-modified asphalt distributed by Hohmann & Barnard, Inc., Hauppauge, N.Y. 11788 may be applied under the base surfaces 58 and 60 for additional protection.

The dimensional relationship between wall anchor 40 and veneer tie 44 limits the axial movement of the construct. Each veneer tie 44 has a rear leg 64 opposite the bed-joint-deposited portion thereof which is formed continuous therewith. The slot or bail aperture 66 of bail 62 is constructed, in accordance with the building code requirements, to be within the predetermined dimensions to limit the z-axis 38 movement. The slot 66 is slightly larger horizontally than the diameter of the tie. The bail-receiving slot 66 is elongated vertically to accept a veneer tie threadedly therethrough and permit y-axis adjustment. The dimensional relationship of the rear leg 64 to the width of bail 62 limits the x-axis movement of the construct. The width of the bail 62 distributes lateral forces in a manner avoiding pin-point loading. For positive interengagement and to prevent disengagement under seismic conditions, the front legs 68 and 70 of veneer tie 44 and the reinforcement wire 46 are sealed in bed joint 30 forming a closed loop.

Figure 4:
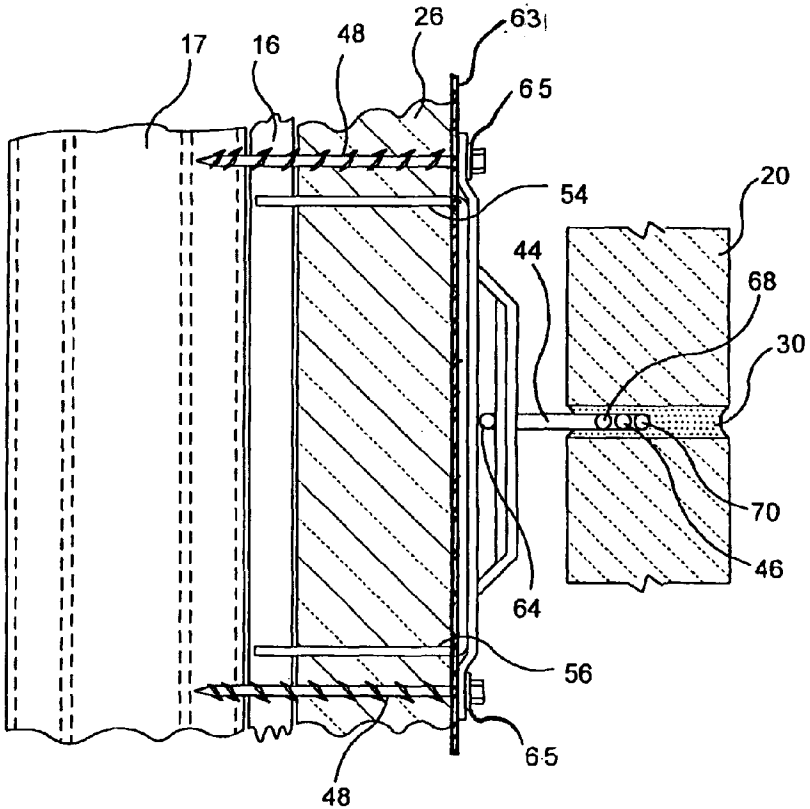
FIG. 4 is a cross sectional view of FIG. 1 which shows the relationship of the surface-mounted anchoring system of this invention to the dry wall construction and to the brick outer wythe.
Figure 3:
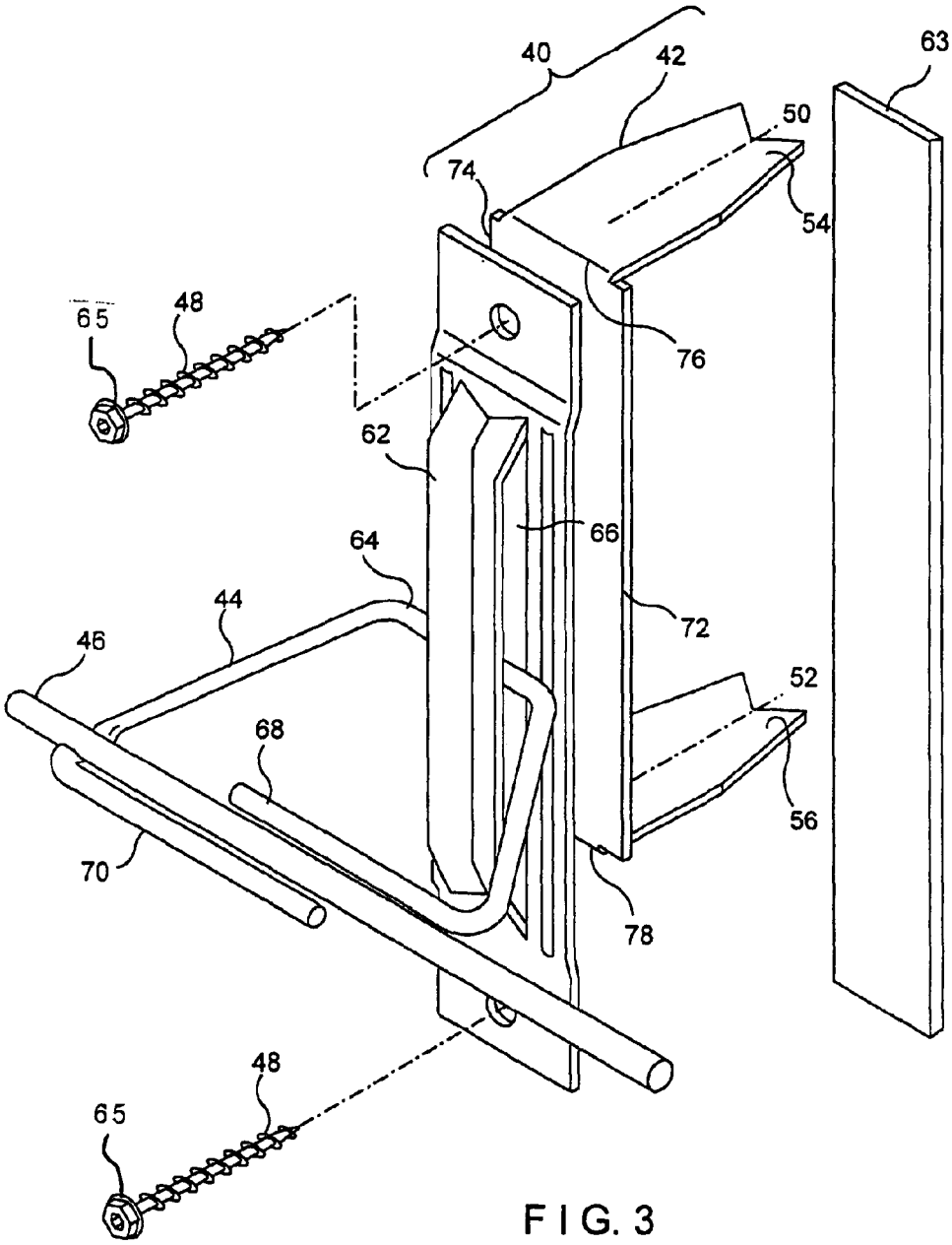
FIG. 3 is a perspective view of the surface-mounted anchoring system of FIG. 1 shown with a two-piece wall anchor, a swaged veneer tie threaded therethrough, and a reinforcing wire for seismic protection.

The two-piece wall anchor 40 is seen in more detail in FIGS. 2 through 4. The legs 54 and 56 are seen as being inset from the edges 72 and 74 and then extending at 90° from the inboard seams 76 and 78, respectively, so as to extend parallel the one to the other. The legs 54 and 56 are dimensioned so that, upon installation, they extend through insulation panels 26 and wallboard 16 and the endpoints 80 thereof abut the metal studs 17. Although only two leg structures are shown, it is within the contemplation of this invention that more two-piece legs could be constructed with each leg terminating at an inboard seam and having the insertion point 82 of the insulation 26 covered by the wall anchor body. Because the legs 54 and 56 abut the studs 17 only at endpoints 80, the thermal conductivity across the construct is minimal as the cross sectional metal-to-metal contact area is minimized. (There is virtually no heat transfer across the mounting hardware 48 because of the nonconductive washers thereof.

Figure 5:
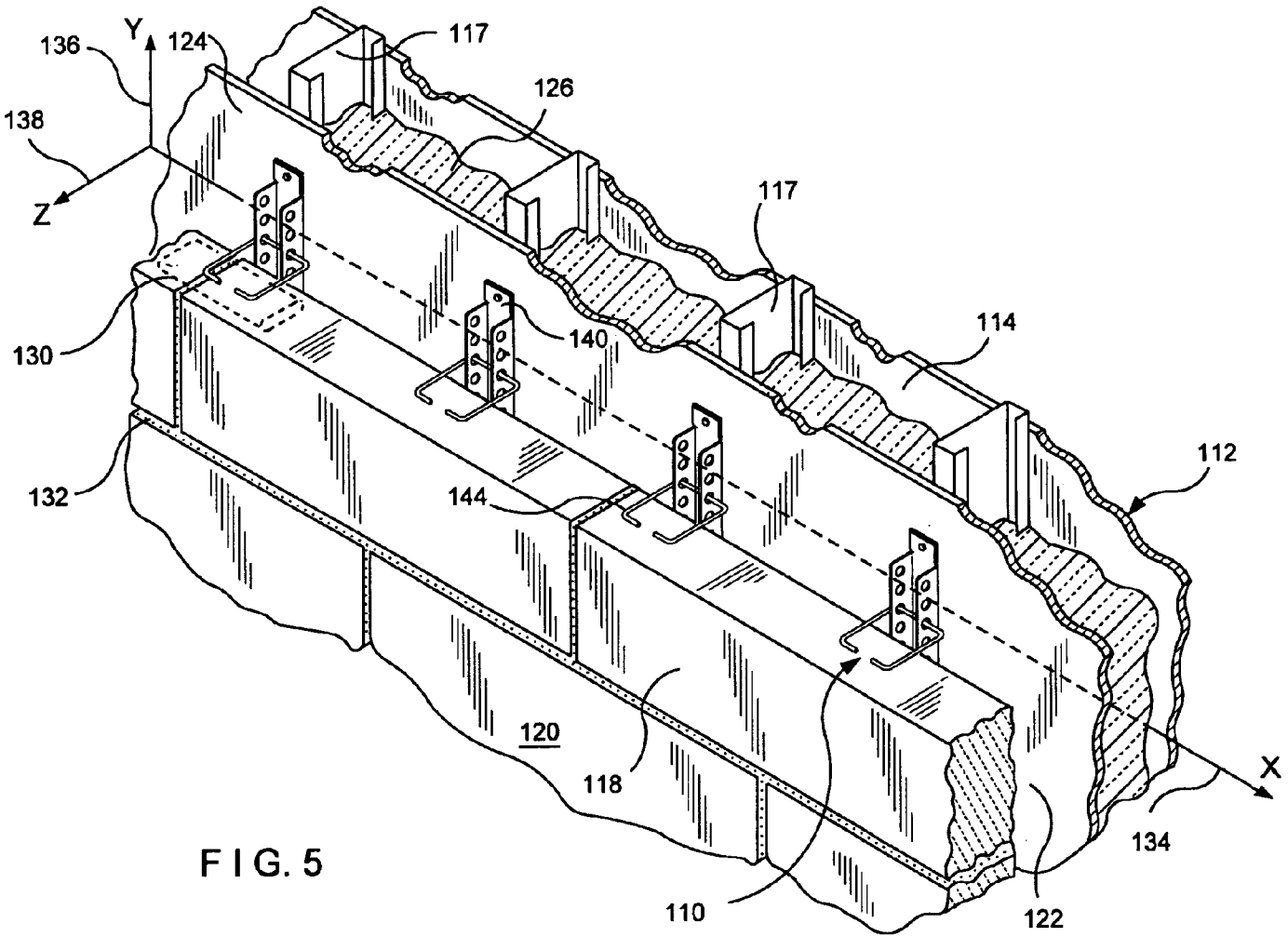
FIG. 5 is a perspective view of a second embodiment of this invention showing a surface-mounted anchoring system for a cavity wall and is similar to FIG. 1, but shows a dry wall construction with interior insulation and a wall anchor construct with perforated wings with a box veneer tie for insertion into the bed joints of the brick veneer facing wall.
Figure 7:
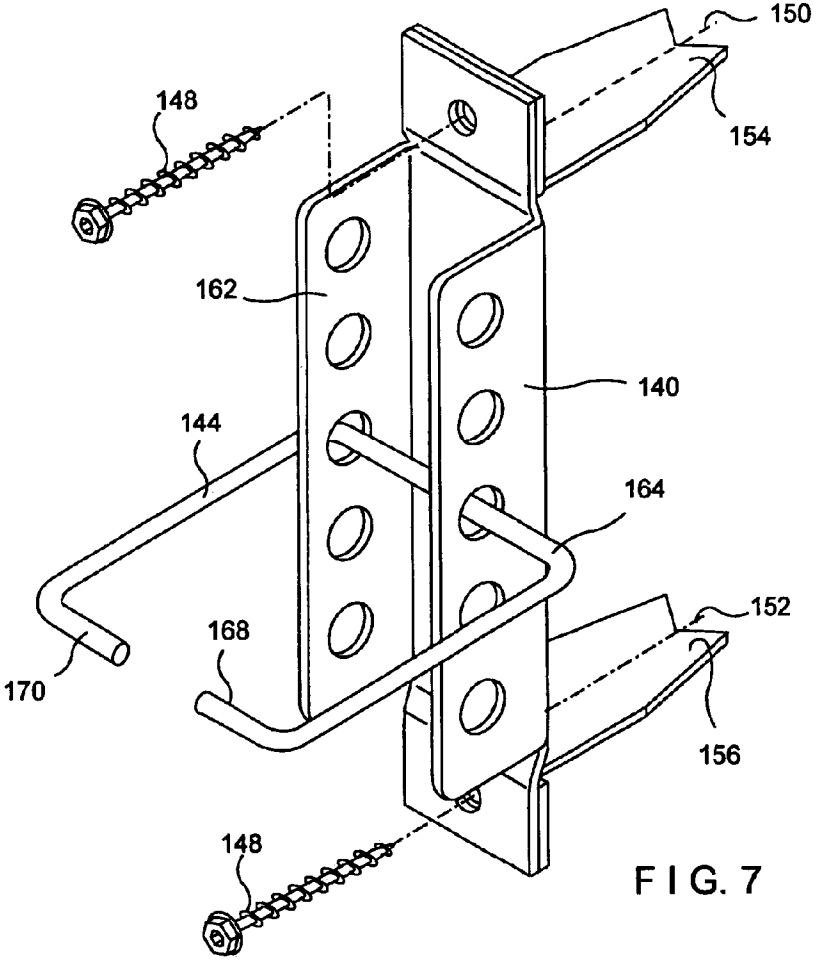
FIG. 7 is a partial perspective view of FIG. 5 showing the relationship of the wall anchor construct with perforated wings and the corresponding veneer tie.
Figure 6:
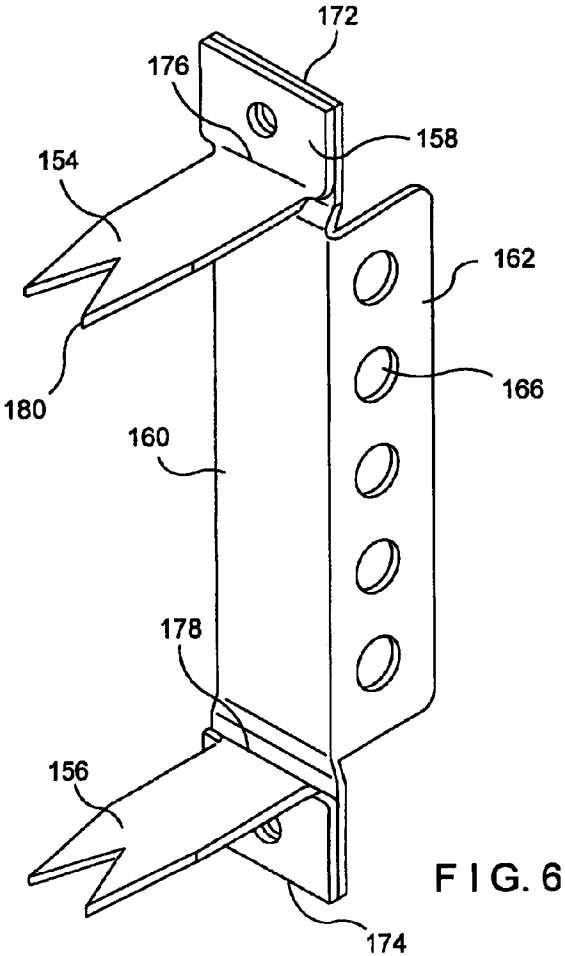
FIG. 6 is a rear perspective view showing the wall anchor construct with perforated wings of FIG. 5.

The description which follows is a second embodiment of the surface-mounted anchoring system for cavity walls of this invention. For ease of comprehension, wherever possible similar parts use reference designators 100 units higher than those above. Thus, the veneer tie 144 of the second embodiment is analogous to the veneer tie 44 of the first embodiment. Referring now to FIGS. 5 through 7, the second embodiment of the surface-mounted anchoring system is shown and is referred to generally by the numeral 110. As in the first embodiment, a wall structure 112 is shown. The second embodiment has an inner wythe or backup wall 114 of a dry wall or a wallboard construct 116 on columns or studs 117 and an outer wythe or veneer 118 of facing stone 120. Here, the anchoring system has a surface-mounted wall anchor with perforated wing portions or receptors for receiving the veneer tie portion of the anchoring system.

The anchoring system 110 is surface mounted to the exterior surface 124 of the inner wythe 114. In this embodiment batts of insulation 126 are disposed between adjacent columns 117. Successive bed joints 130 and 132 are substantially planar and horizontally disposed and in accord with building standards are 0.375-inch (approx.) in height. Selective ones of bed joints 130 and 132, which are formed between courses of bricks 120, are constructed to receive therewithin the insertion portion of the anchoring system construct hereof. Being surface mounted onto the inner wythe, the anchoring system 110 is constructed cooperatively therewith, and as described in greater detail below, is configured to penetrate through the wallboard at a covered insertion point.

For purposes of discussion, the cavity surface 124 of the inner wythe 114 contains a horizontal line or x-axis 134 and an intersecting vertical line or y-axis 136. A horizontal line or z-axis 138, normal to the xy-plane, passes through the coordinate origin formed by the intersecting x- and y-axes. A wall anchor construct 140 is shown which has a pair of legs 142 which penetrate the wallboard 116. The wall anchor 140 is a stamped metal construct which is constructed for surface mounting on inner wythe 114 and for interconnection with veneer tie 144.

The veneer tie 144 is a box Byna-Tie® device manufactured by Hohmann & Barnard, Inc., Hauppauge, N.Y. 11788. The veneer tie 144 is shown in FIG. 5 as being emplaced on a course of bricks 120 in preparation for embedment in the mortar of bed joint 130. In this embodiment, the system includes a wall anchor 140 and a veneer tie 144.

At intervals along a horizontal line surface 124, wall anchors 140 are surface-mounted using mounting hardware 148 with neoprene sealing washers. The wall anchors 140 are positioned on surface 124 so that the longitudinal axis of a column 117 lies within the yz-plane formed by the longitudinal axes 150 and 152 of upper leg 154 and lower leg 156, respectively. The legs 154 and 156 are separate L-shaped pieces, as best shown in FIG. 6, so that the base surface 158 of the leg portions and the intermediate base surface 160 are substantially coplanar and, when installed, lie in an xy-plane. Upon insertion in the wallboard 116, the base surfaces 158 and 160 surround and rest snugly against the leg insertion openings. The surfaces 158 and 160 cover the openings precluding the passage of air and moisture therethrough and maintaining the insulation integrity. It is within the contemplation of this invention that a coating of sealant or a layer of a polymeric compound—such as a closed-cell foam—be placed on base surfaces 158 and 160 for additional sealing.

In the second embodiment, perforated wing portions 162 therealong are bent upwardly (when viewing legs 142 as being bent downwardly) from intermediate base 160 for receiving veneer tie 144 therethrough. The dimensional relationship between wall anchor 140 and veneer tie 144 limits the axial movement of the construct. Each veneer tie 144 has a rear leg 164 opposite the bed-joint deposited portion thereof, which rear leg 164 is formed continuous therewith. The perforations 166 provide for selective adjustability and, unlike the other embodiments hereof, similarly restrict both the y-axis 136 and the z-axis 138 movement of the anchored veneer. The opening of the perforation 166 of wing portions 162 is constructed to be within the predetermined dimensions to limit the z-axis 138 movement in accordance with the building code requirements. The perforation 166 is slightly larger horizontally than the diameter of the tie 144. If y-axis 136 adjustability is desired, the perforations 166 may be elongated vertically. The dimensional relationship of the rear leg 164 to the width of spacing between wing portions 162 limits the x-axis movement of the construct. Here the wingspan not only limits movement, but also avoids pin-point laoding. For positive interengagement, the front legs 168 and 170 of veneer tie 144 are sealed in bed joint 130 forming a closed loop.

The wall anchor construct 140 is seen in more detail in FIGS. 6 and 7. The upper legs 154 and lower leg 156 are separate L-shaped pieces welded to recessed ends 172 and 174, respectively, and then extending at 90° parallel the one to the other to the inboard seams 176 and 178, respectively. The legs 154 and 156 are dimensioned so that, upon installation, they extend through wallboard 116 and the endpoints 180 thereof abut the metal studs 117. Although only two leg structures are shown, it is within the contemplation of this invention that more legs could be constructed with each leg terminating at an inboard seam and having the insertion point 182 of the wallboard 116 covered by the wall anchor body. Because the legs 154 and 156 abut the studs 117 only at endpoints 180, the thermal conductivity across the construct is minimal as the cross sectional metal-to-metal contact area is minimized. (There is virtually no heat transfer across the mounting hardware 148 because of the nonconductive washers thereof.

Figure 8:
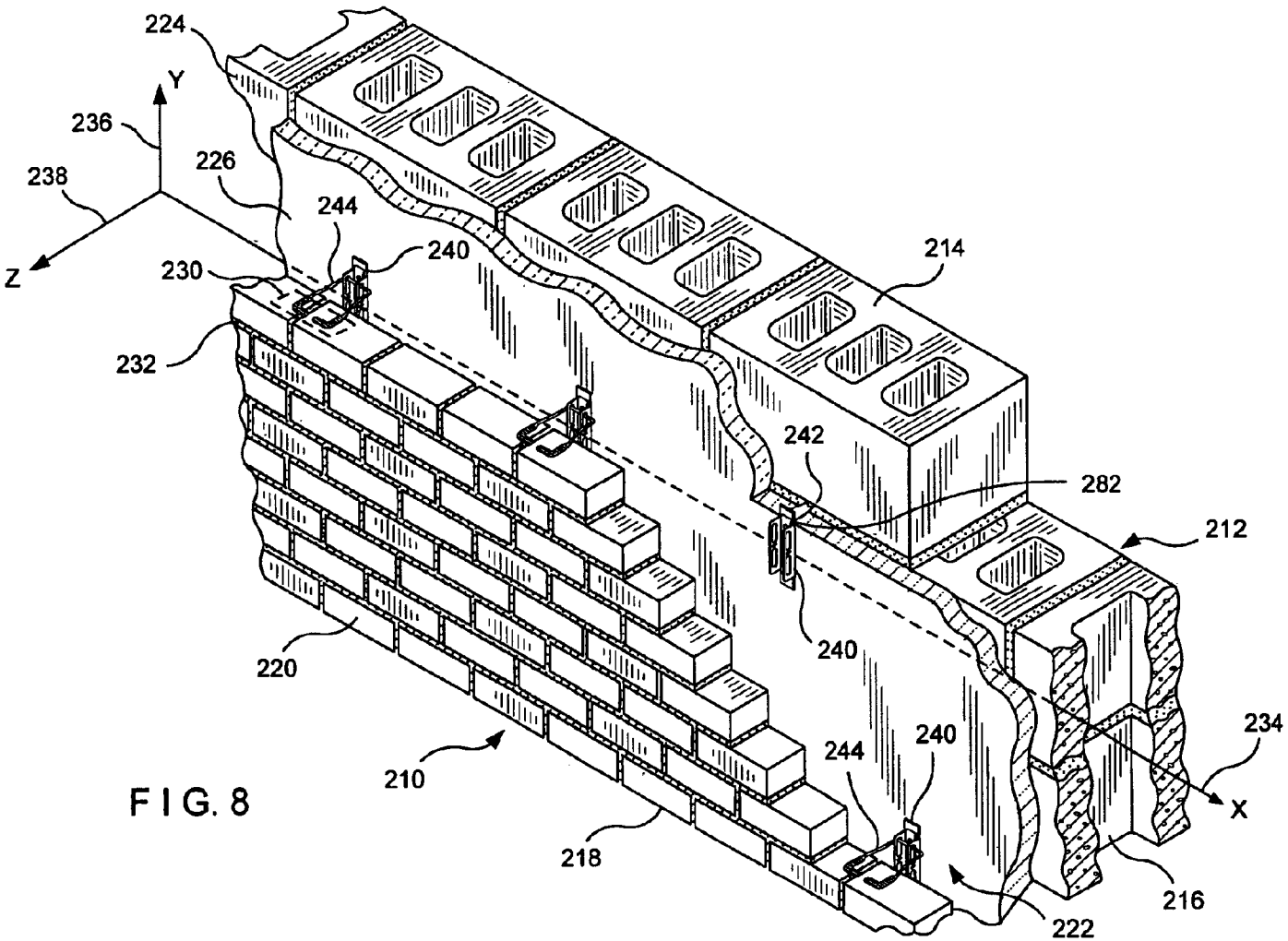
FIG. 8 is a perspective view of a third embodiment of this invention showing a surface-mounted anchoring system for a cavity wall and is similar to FIG. 1, but shows a masonry block backup wall with a wall anchor construct with slotted wings and a low-profile, canted veneer tie.
Figure 10:
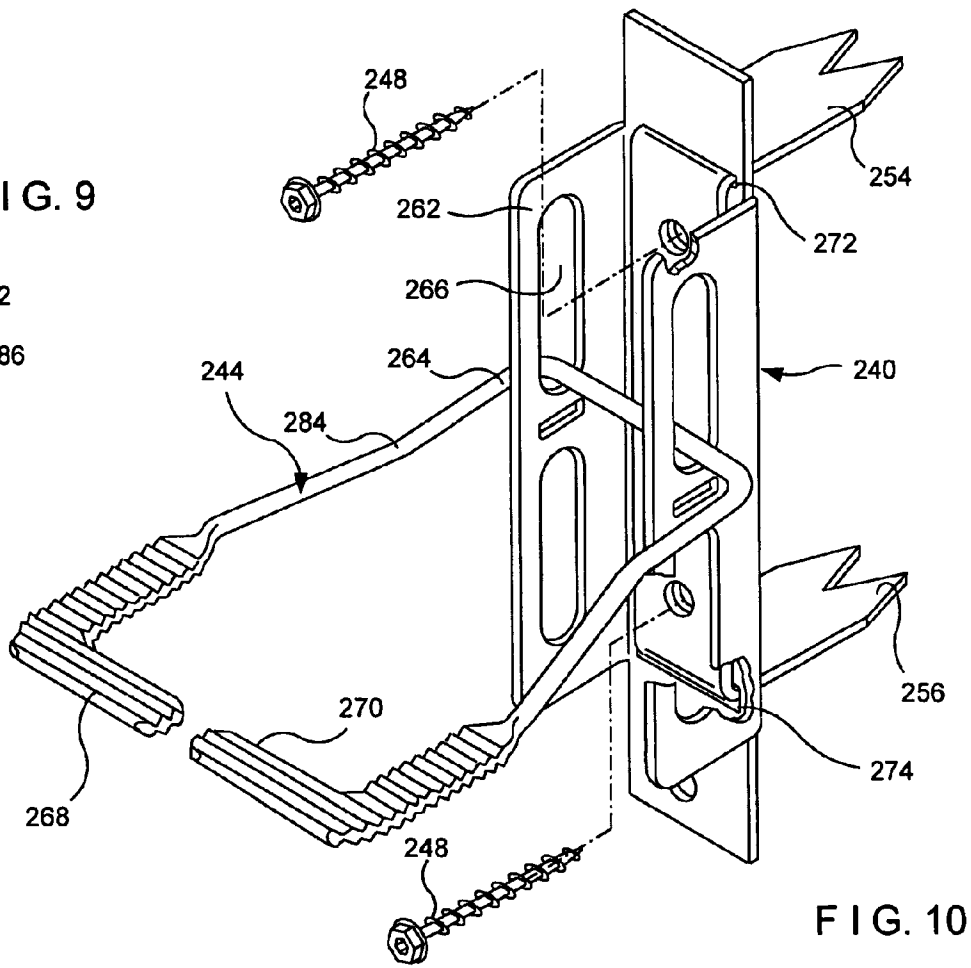
Figure 9:
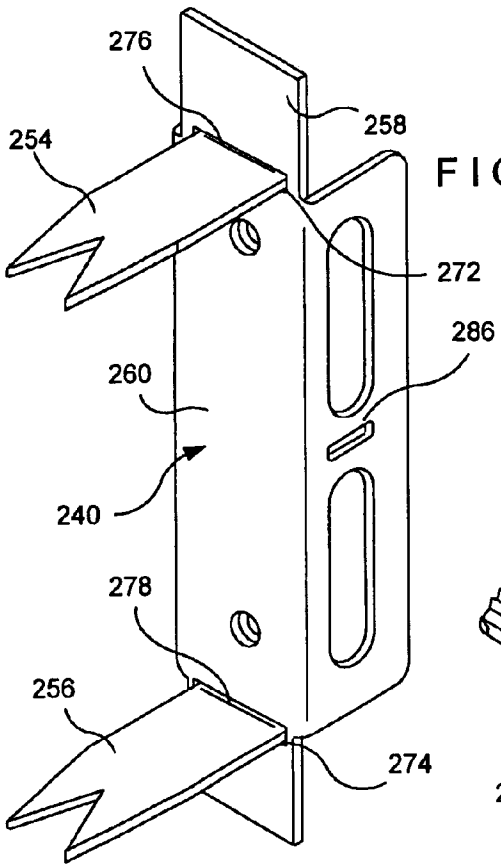
FIG. 9 is a rear perspective view showing the wall anchor construct with slotted wings of FIG. 8; and, FIG. 10 is a partial perspective view of FIG. 8 showing the relationship of the wall anchor construct and the corresponding veneer tie.

The description which follows is a third embodiment of the surface-mounted anchoring system for cavity walls of this invention. For ease of comprehension, wherever possible similar parts use reference designators 100 units higher than those above. Thus, the veneer tie 244 of the third embodiment is analogous to the veneer tie 144 of the second embodiment. Referring now to FIGS. 8 through 10, the third embodiment of the surface-mounted anchoring system is shown and is referred to generally by the numeral 210. As in the previous embodiments, a wall structure 212 is shown. Here, the third embodiment has an inner wythe or backup wall 214 of masonry block 216 and an outer wythe or veneer 218 of facing brick 220. The anchoring system has a surface-mounted wall anchor construct with slotted wing portions or receptors for receiving the veneer tie portion of the anchoring system and a low-profile box tie.

The anchoring system 210 is surface mounted to the exterior surface 224 of the inner wythe 214. In this embodiment panels of insulation 226 are disposed on the masonry block 216. Successive bed joints 230 and 232 are substantially planar and horizontally disposed and in accord with building standards are 0.375-inch (approx.) in height. Selective ones of bed joints 230 and 232, which are formed between courses of bricks 220, are constructed to receive therewithin the insertion portion of the anchoring system construct hereof. Being surface mounted onto the inner wythe, the anchoring system 210 is constructed cooperatively therewith, and as described in greater detail below, is configured to penetrate through the insulation at a covered insertion point.

For purposes of discussion, the cavity surface 224 of the inner wythe 214 contains a horizontal line or x-axis 234 and an intersecting vertical line or y-axis 236. A horizontal line or z-axis 238, normal to the xy-plane, passes through the coordinate origin formed by the intersecting x- and y-axes. A two-piece wall anchor 240 is shown which has a pair of legs 242 which penetrate the insulation 226. Two-piece wall anchor 240 is a stamped metal construct which is constructed for surface mounting on inner wythe 214 and for interconnection with veneer tie 244.

The veneer tie 244 is adapted from the low-profile box Byna-Tie® device manufactured by Hohmann & Barnard, Inc., Hauppauge, N.Y. 11788 under U.S. Pat. No. 6,279,283. The veneer tie 244 is shown in FIG. 8 as being emplaced on a course of bricks 220 in preparation for embedment in the mortar of bed joint 230. In this embodiment, the system includes a two-piece wall anchor 240 and a canted veneer tie 244.

At intervals along a horizontal line surface 224, two-piece wall anchors 240 are surface-mounted using masonry mounting hardware 248. The two-piece wall anchors 240 are positioned on surface 224 at the intervals required by the applicable building codes. The upper leg 254 and lower leg 256 are inserted through the wall anchor body 240, as best shown in FIG. 9, so that the base surface 258 and, when installed, lies in an xy-plane about the leg insertion openings. Upon insertion in insulation 226, the base surface 258 rests snugly against the openings formed by the legs and serves to cover the opening precluding the passage of air and moisture therethrough, thereby maintaining the insulation integrity. It is within the contemplation of this invention that a coating of sealant or a layer of a polymeric compound—such as a closed-cell foam—be placed on base surface 258 for additional sealing.

In the third embodiment, slotted wing portions 262 therealong are bent upwardly (when viewing legs 242 as extending downwardly) from base 258 for receiving veneer tie 244 therethrough. The dimensional relationship between wall anchor 240 and veneer tie 244 limits the axial movement of the construct. Each veneer tie 244 has a rear leg 264 opposite the bed-joint deposited portion thereof, which rear leg 264 is formed continuous therewith. The slots 266 provide for adjustability and, unlike the second embodiment hereof, do not restrict the y-axis 236 movement of the anchored veneer. The opening of the slot 266 of wing portions 262 is constructed to be within the predetermined dimensions to limit the z-axis 238 movement in accordance with the building code requirements. The slots 266 are slightly larger horizontally than the diameter of the tie 244. The dimensional relationship of the rear leg 264 to the width of spacing between wing portions 262 limits the x-axis movement of the construct. For positive interengagement, the front legs 268 and 270 of veneer tie 244 are sealed in bed joint 230 forming a closed loop.

The two-piece wall anchor 240 is seen in more detail in FIGS. 9 and 10. The upper leg 254 and lower leg 256 extend through slots 272 and 274, respectively, and bend 90° at the inboard seams 276 and 280, respectively, so as to extend parallel the one to the other. The legs 254 and 256 are dimensioned so that, upon installation, they extend through insulation panels 226 and the endpoints 280 thereof abut the exterior surface 224 of masonry block 216. Because the insertion point 282 into insulation 226 of the legs 254 and 256 is sealingly covered by the structure, the water and water vapor penetration into the backup wall is minimal.

In the veneer tie shown in FIGS. 8 and 10, a bend is made at a point of inflection 284. This configuring of the veneer tie 244, compensates for the additional strengthening of wall anchor 240 at crossbar 266. Thus, if the bed joint 230 is exactly coplanar with the strengthening crossbar 286 the bent veneer tie 244 facilitates the alignment thereof.

In the above description of the two-piece wall anchors of this invention various configurations are described and applications thereof in corresponding anchoring systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A surface-mounted anchoring system for use in the construction of a wall having an inner wythe and an outer wythe, said outer wythe formed from a plurality of successive courses with a bed joint between each two adjacent courses, said inner wythe and said outer wythe in a spaced apart relationship the one with the other forming a cavity therebetween, said inner wythe having an exterior layer selected from a group consisting of insulation, wallboard, and insulation and wallboard, said surface-mounted anchoring system comprising:

a wall anchor having a planar body with two major faces and a perimeter, said wall anchor, in turn, comprising;

a pair of legs, each extending from one face of said planar body from an inboard location thereof with the longitudinal axis of each of said legs being substantially normal to said face, said legs adapted for insertion at a predetermined insertion point into said exterior layer of said inner wythe, said inboard location set in from said perimeter enabling a cover portion formed from said face of said planar body and portion of said legs to preclude penetration of air, moisture and water vapor into said exterior layer;

an apertured receptor portion adjacent a second face of said planar body, said apertured receptor portion adapted to limit displacement of said outer wythe toward and away from said inner wythe; and, a veneer tie threadedly disposed through said apertured receptor portion of said wall anchor and adapted for embedment in said bed joint of said outer wythe so as to prevent disengagement from said anchoring system.

2. A surface-mounted anchoring system as described in claim 1, wherein said anchoring system further comprises:

a reinforcement wire disposed in said bed joint; and, wherein said veneer tie further comprises:

an attachment portion for threading through said apertured receptor;

an insertion portion contiguous with and opposite said attachment portion, said insertion portion being swaged for interconnection with said reinforcement wire;

whereby, upon installation of said anchoring system with an interconnected reinforcing wire in said outer wythe, said system provides a high degree of seismic protection.

3. A surface-mounted anchoring system as described in claim 1, wherein said anchoring system further comprises:

sealant means for further sealing between said planar body and said exterior layer.

4. A surface-mounted anchoring system described in claim 3, wherein said sealant means is adhered to said exterior layer prior to mounting said wall anchor thereon.

5. A surface-mounted anchoring system as described in claim 3, wherein said sealant means is a coating on said cover portion of said planar body.

6. A surface-mounted anchoring system as described in claim 1, wherein a base of said planar body and a base of said pair of said legs are substantially coplanar.

7. A surface-mounted anchoring system as described in claim 1 wherein said apertured receptor portion is an opening between a bail formed from the planar body and said second face of said planar body.

8. A wall anchor construct for use in a wall having an inner wythe and an outer wythe, said outer wythe formed from a plurality of successive courses with a bed joint between each two adjacent courses, said inner wythe and said outer wythe in a spaced apart relationship the one with the other forming a cavity therebetween, said inner wythe having an exterior layer selected from a group consisting of insulation, wallboard, and insulation and wallboard, said wall anchor construct comprising:

an anchor base having two major surfaces with one of said major surfaces being a mounting surface adapted for disposition on said exterior layer;

a receptor body atop the major surface opposite the mounting surface, said receptor body adapted to receive therethrough one end of a veneer tie with the opposite end thereof for embedment in said bed joint of said outer wythe;

one or more leg bases disposed on said anchor base;

at least two legs extending from said one or more leg bases and, when said one or more leg bases are disposed on said anchor base, extend normal to the mounting surface and inboard from the periphery thereof, and extend away from said receptor body; and, said mounting surface, upon insertion of said legs into said exterior layer at a predetermined insertion point, covering the opening made thereby so as to seal the area surrounding said insertion point to preclude the entry of air, water and water vapor into said exterior layer.

9. A wall anchor construct as described in claim 8, wherein said one or more leg bases and said legs is a U-shaped leg assembly and wherein said anchor base further comprises:

a recess therein dimensioned to accept in a nesting relationship base of said U-shaped leg assembly and to maintain said seal of said mounting surface at said insertion point.

10. A wall anchor construct as described in claim 9 wherein said receptor body comprises a bail stamped out from said anchor base and further comprises:

a tie-receiving aperture between said bail and said anchor base adapted to receive a veneer tie therethrough, said veneer tie being vertically adjustable to align with said bed joint.

11. A wall anchor construct as described in claim 9 wherein said legs are narrower than said anchor base and disposed entirely inboard of the planar boundaries of said anchor base, to maintain said seal of said mounting surface at said insertion point.

12. A wall anchor construct as described in claim 8 wherein said one or more leg bases and said at least two legs are formed by two L-shaped leg assemblies and wherein said anchor base further comprises:

a pair of recesses therein each dimensioned to accept in a nesting relationship the base of one of said L-shaped leg assemblies, said legs further being narrower than said anchor base and disposed entirely inboard of the planar boundaries of said anchor base, to maintain said seal of said mounting surface at said insertion point.

13. A wall anchor construct as described in claim 12 wherein said receptor body comprises a bail stamped from said anchor base and further comprises:

a tie-receiving aperture between said bail and said anchor base adapted to receive a veneer tie therethrough, said veneer tie being vertically adjustable to align with said bed joint.

* * * * *